US008115710B2

(12) United States Patent
Jong et al.

(10) Patent No.: US 8,115,710 B2
(45) Date of Patent: Feb. 14, 2012

(54) LIQUID CRYSTAL DISPLAY CONTROL CIRCUIT FOR REDUCING MEMORY SIZE BY DETECTING IMAGE EDGES AND SAVING EDGE DATA AND METHOD THEREOF

(75) Inventors: Her-Ming Jong, Hsinchu (TW); Yun-Hung Shen, Hsin-Chu (TW); Yi-Liang Lu, Hsin-Chu (TW)

(73) Assignee: MStar Semiconductor, Inc., ChuPei, Hsin-Chu Hsien (TW)

( * ) Notice: Subject to any disclaimer, the term of this patent is extended or adjusted under 35 U.S.C. 154(b) by 932 days.

(21) Appl. No.: 11/382,715

(22) Filed: May 11, 2006

(65) Prior Publication Data

US 2007/0063956 A1 Mar. 22, 2007

Related U.S. Application Data

(60) Provisional application No. 60/596,415, filed on Sep. 21, 2005.

(51) Int. Cl.
*G09G 3/36* (2006.01)

(52) U.S. Cl. ..... 345/87

(58) Field of Classification Search ..... 345/204, 345/690, 87–97, 98–101, 102–104, 208, 345/617

See application file for complete search history.

(56) References Cited

U.S. PATENT DOCUMENTS

| | | | | |
|---|---|---|---|---|
| 2002/0175907 | A1 | 11/2002 | Sekiya | |
| 2003/0231158 | A1 * | 12/2003 | Someya et al. | 345/101 |
| 2004/0140985 | A1 * | 7/2004 | Liaw | 345/690 |
| 2004/0178984 | A1 * | 9/2004 | Park et al. | 345/100 |
| 2004/0263495 | A1 * | 12/2004 | Sugino et al. | 345/204 |
| 2005/0030302 | A1 * | 2/2005 | Nishi et al. | 345/204 |
| 2005/0068334 | A1 * | 3/2005 | Chang et al. | 345/617 |
| 2005/0068343 | A1 * | 3/2005 | Pan et al. | 345/690 |
| 2005/0200589 | A1 * | 9/2005 | Takatori | 345/98 |
| 2005/0237316 | A1 * | 10/2005 | Huang et al. | 345/204 |
| 2006/0066554 | A1 * | 3/2006 | Baba et al. | 345/98 |
| 2006/0221038 | A1 * | 10/2006 | Solf et al. | 345/98 |
| 2008/0204393 | A1 * | 8/2008 | Ben-David | 345/98 |

FOREIGN PATENT DOCUMENTS

| | | |
|---|---|---|
| TW | I227007 | 1/2005 |
| TW | I230010 | 3/2005 |

* cited by examiner

*Primary Examiner* — Chanh Nguyen
*Assistant Examiner* — Sanghyuk Park
(74) *Attorney, Agent, or Firm* — Winston Hsu; Scott Margo

(57) ABSTRACT

A liquid crystal display (LCD) control circuit is disclosed. The control circuit includes an edge detecting circuit for detecting image edges in each frame of an image data, and outputting an edge data and a non-edge data; a memory for saving the edge data of the frame; a driving decision circuit for generating a driving voltage setting according to the non-edge data of a current frame, and generating an overdriving voltage setting according to the edge data of a previous frame saved in the memory and the edge data of the current frame outputted by the edge detecting circuit; and an output device for outputting the driving voltage setting and the overdriving voltage setting.

11 Claims, 4 Drawing Sheets

LIQUID CRYSTAL DISPLAY CONTROL CIRCUIT FOR REDUCING MEMORY SIZE BY DETECTING IMAGE EDGES AND SAVING EDGE DATA AND METHOD THEREOF

CROSS REFERENCE TO RELATED APPLICATIONS

This application claims the benefit of U.S. Provisional Application No. 60/596,415, which was filed on Sep. 21, 2005 and is included herein by reference.

BACKGROUND OF THE INVENTION

1. Field of the Invention

The present invention relates to a liquid crystal display (LCD) control circuit and a control method thereof, and more specifically, to a control circuit and a method thereof that detects image edges of frames to reduce memory size by decreasing saved pixel data when executing the overdriving procedures.

2. Description of the Prior Art

Liquid crystal display (LCD) panels are mass-produced products applied to the field of computers, monitors, and TVs. The operation principle of an LCD is to vary voltages dropped on two terminals of liquid crystal cells in order to change a twisted angle of the liquid crystal cells. The transparency of the liquid crystal cells is changed for achieving the desired objective of illustrating images. Therefore, accurately and appropriately controlling the voltages between two terminals of liquid crystal cells is a key point for showing images rapidly and clearly.

It is well known by those skilled in the art that overdriving procedures are usually executed to reduce response time of the liquid crystal cells as images vary rapidly. Please refer to FIG. 1. FIG. 1 is a block diagram of an LCD control circuit 100 according to the prior art. The control circuit 100 receives a gray level value of every pixel and determines the voltage applied on the two terminals of the liquid crystal cell corresponding to a pixel unit in accordance with the gray level value difference of the pixel unit between a current frame and a previous frame. As FIG. 1 shows, the control circuit 100 includes a buffer circuit 110, a frame memory 120, and a driving-decision circuit 130. Gray level values $D_{in}$ of pixels are inputted into the control circuit 100 and then delivered to the driving decision circuit 130 and the frame memory 120 respectively through the buffer circuit 110. The symbol $G_n$ in the figure shows the data is the gray level value of pixels in the current frame. The frame memory 120 records inputted gray level values and outputs a pre-saved gray level value $G_{n-1}$ that corresponds to the pixels in the previous frame to the driving decision circuit 130. Next, the driving decision circuit 130 compares the gray level value $G_n$ of the current frame and the gray level value $G_{n-1}$ of the previous frame and then compares the difference between these two gray level values with the value saved in a look-up table to determine whether the control circuit 100 has to execute overdriving procedures and therefore whether a corresponding voltage will be dropped on the liquid crystal cells when the overdriving procedure is executed. Finally, the driving-decision circuit 130 outputs a driving voltage setting $S_{out}$ to a voltage supply circuit to provide the voltage dropped on two terminals of the liquid crystal layer.

Because the frame memory 120 has to save gray level values of all pixels in a frame, the memory size needs to be large enough to include the gray level values of all pixels in a frame. However, the larger the memory size is, the more expensive it becomes.

SUMMARY OF THE INVENTION

It is therefore one of the objectives of the claimed invention to provide a liquid crystal display (LCD) control circuit and a control method, to solve the above-mentioned problems.

According to an embodiment of the present invention, an LCD control circuit is disclosed. The control circuit includes an edge-detecting circuit for detecting image edges in each frame of an image data, and outputting an edge data and a non-edge data corresponding to each frame; a memory coupled to the edge-detecting circuit, for saving the edge data of the frame; a driving decision circuit coupled to the edge-detecting circuit and the memory, for generating a driving voltage setting according to the non-edge data of a current frame outputted by the edge-detecting circuit, and generating an overdriving voltage setting according to the edge data of a previous frame saved in the memory and the edge data of the current frame outputted by the edge detecting circuit; and an output device coupled to the driving decision circuit, for outputting the driving voltage setting and the overdriving voltage setting.

According to another embodiment of the present invention, an LCD control method is disclosed. The method includes: detecting image edges in each frame of an image data, and outputting an edge data and a non-edge data corresponding to each frame; saving the edge data of the frame; generating a driving voltage setting according to the non-edge data of a current frame and generating an overdriving voltage setting according to the edge data of a previous frame and the edge data of the current frame; and outputting the driving voltage setting and the overdriving voltage setting.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
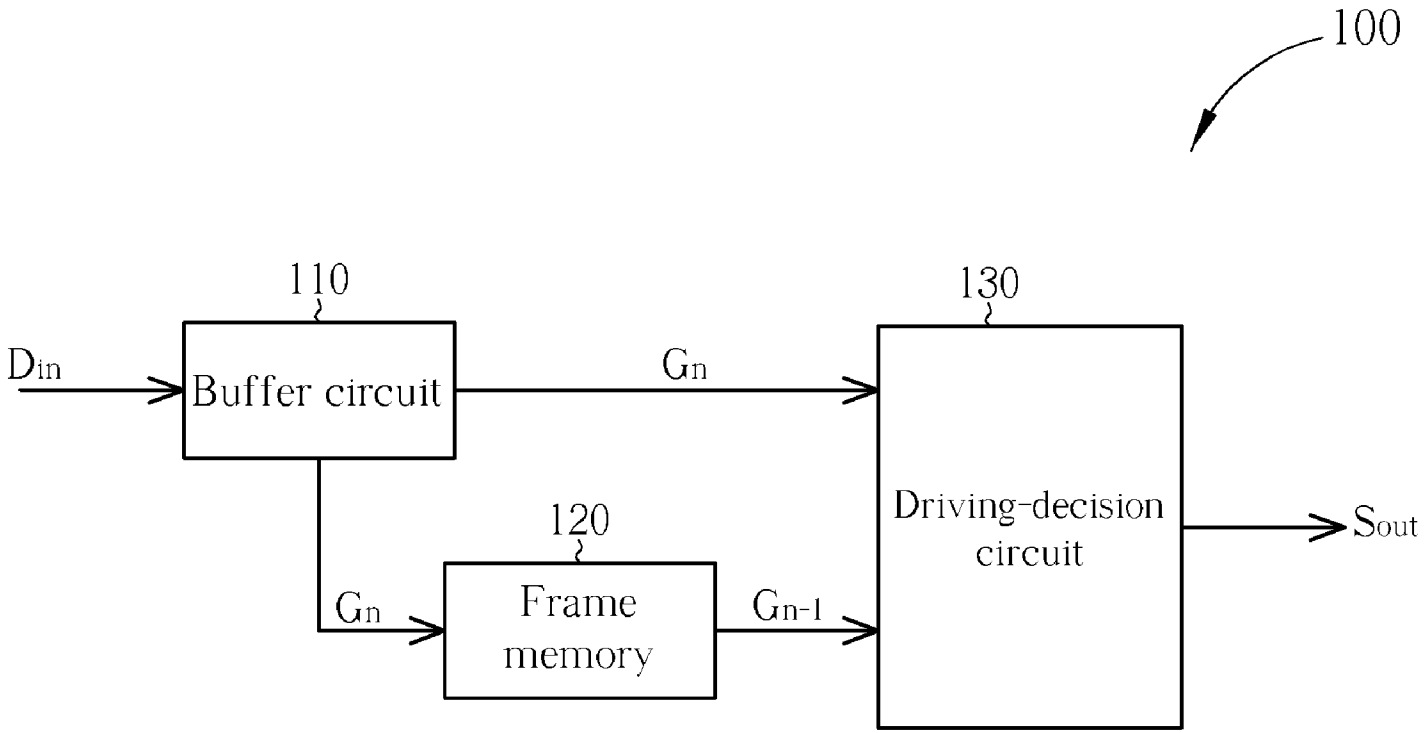
Fig. 1 Prior Art
FIG. 1 is a block diagram of an LCD control circuit according to the prior art.
Figure 2:
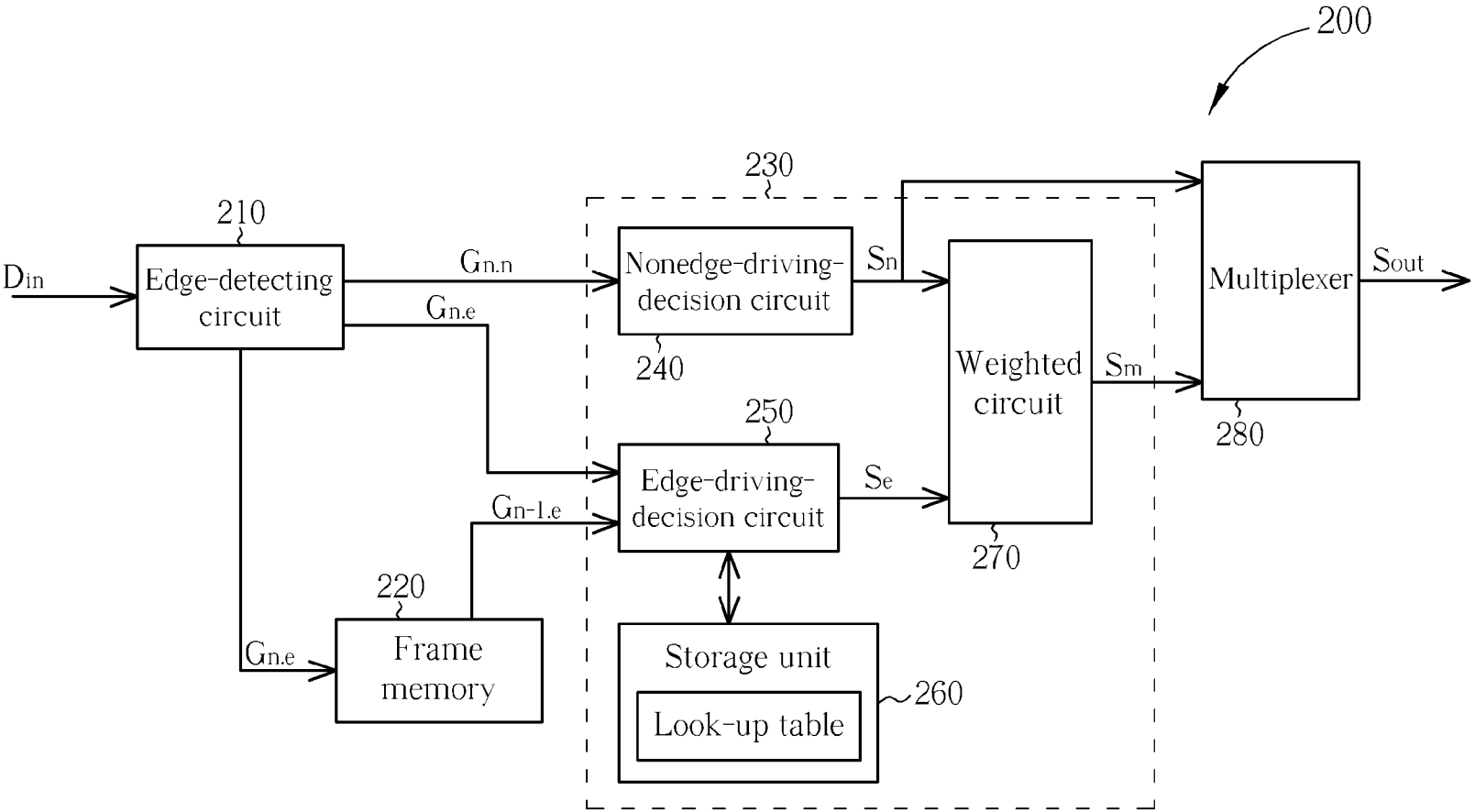
FIG. 2 is a block diagram of the LCD control circuit according to a preferred embodiment of the present invention.

Please refer to FIG. 2. FIG. 2 is a block diagram of the LCD control circuit 200 according to a preferred embodiment of the present invention. The control circuit 200 includes an edge-detecting circuit 210, a frame memory 220, a driving decision circuit 230, and a multiplexer 280, wherein the driving decision circuit 230 consists of a non-edge-driving decision circuit 240, an edge-driving decision circuit 250, a storage unit 260, and a weighted circuit 270. The operation principle of the control circuit 200 is described in the following.

Initially, the gray level values $D_{in}$ of every pixel in the frame are inputted into the edge-detecting circuit 210, and the edge-detecting circuit 210 detects edge parts of images in the current frame, then classifies the pixel data of the current frame into edge data and non-edge data. The pixel data of edge parts is classified as the edge data and the pixel data of the other parts is classified as the non-edge data. There are many methods, known by those skilled in the art, for detecting the edge parts of images. For example, by comparing gray level values of a pixel and other neighboring pixels in the same frame, it can be determined that the pixel and other neighboring pixels respectively belong to different objects if the gray level values of these pixels are very different. Therefore, the pixel is classified into the edge part. The edge-detecting circuit 210 outputs the non-edge data $G_{n,n}$ of the current frame to the non-edge-driving decision circuit 240 positioned in the driving decision circuit 230, and outputs the edge data $G_{n,e}$ of the current frame to the frame memory 220 and the edge-driving decision circuit 250.

As frames are continuous, if the object is moving, only pixel data (such as light intensity, color etc.) in the edge part of the image has great variation; in other words, only the liquid crystal layer of these pixels in the edge part has to execute an overdriving voltage setting, whereas the liquid crystal layer of other pixels in the other parts of the frame merely needs to execute a general driving voltage setting. Therefore, the non-edge-driving decision circuit 240 generates the driving voltage setting $S_n$ corresponding to the non-edge part of the current frame according to the non-edge data $G_{n,n}$ (such as the gray level value of the pixel) of the current frame.

The frame memory 220 saves the edge data $G_{n,e}$ (such as the gray level value of the pixel) of the current frame outputted from the edge-detecting circuit 210, and then outputs pre-saved edge data $G_{n-1,e}$ of the previous frame to the edge-driving decision circuit 250. The edge-driving decision circuit 250 compares two edge data $G_{n,e}$, $G_{n-1,e}$ that respectively correspond to the current frame and the previous frame, and accesses a look-up table stored in the storage unit 260 in accordance with the difference between these two edge data in order to determine the voltage setting of the liquid crystal layer. For example, if the difference between the edge data $G_{n,e}$ of the current frame and the edge data $G_{n-1,e}$ the previous frame is greater than a threshold value, it means that the edge data varies greatly in these two continuous frames. Hence the look-up table must be accessed to obtain a suitable overdriving voltage setting $S_e$ corresponding to the difference for accelerating the response time of the liquid crystal cells. Please note that because the frame memory 220 only has to save edge data rather than the data of all pixels of the frame, the necessary memory size of the present invention is smaller than the memory size required in the prior art.

Figure 3:
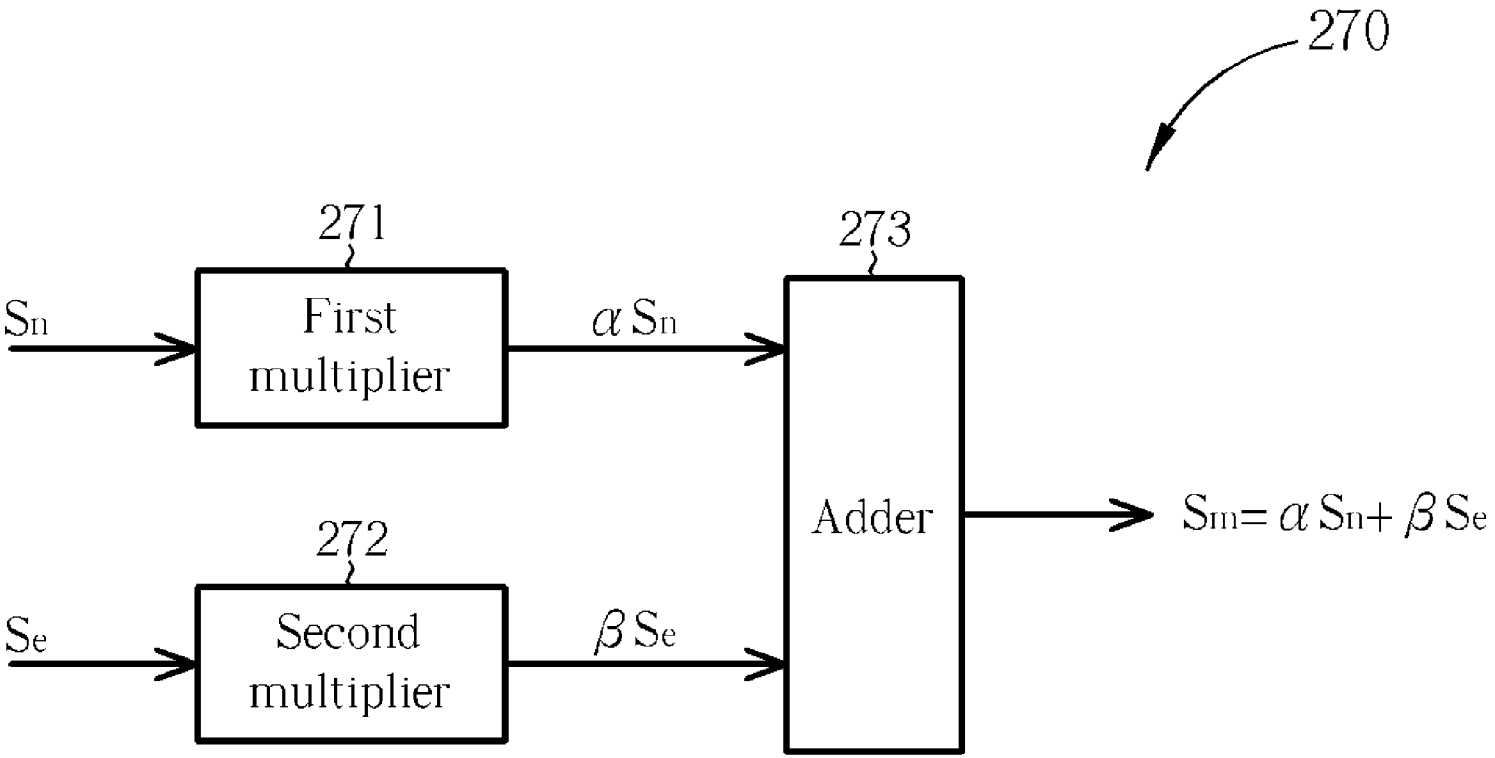
FIG. 3 is a block diagram of the weighted circuit shown in FIG. 2 according to a preferred embodiment of the present invention.

In a preferred embodiment of the present invention, for avoiding error and increasing stability of the control circuit 200, the driving voltage setting $S_n$ corresponding to the non-edge part of the current frame and the overdriving voltage setting $S_e$ corresponding to the edge part of the current frame are inputted into a weighted circuit 270. The weighted circuit 270 references the driving voltage setting $S_n$ of the pixels located at the non-edge part neighboring the image edge part for adjusting an initial overdriving voltage setting $S_e$ of the edge part, and the weighted circuit 270 then generates a modified overdriving voltage setting $S_M$ corresponding to the edge part of the current frame. There are many methods for the weighted circuit 270 to execute the weighted operation. For example, please refer to FIG. 3. FIG. 3 is a block diagram of the weighted circuit 270 shown in FIG. 2 according to a preferred embodiment of the present invention. The weighted circuit 270 includes a first multiplier 271, a second multiplier 272, and an adder 273. The first multiplier 271 firstly multiplies the driving voltage setting $S_n$ of at least one pixel located at the non-edge part next to the edge part in the current frame with a first weighted factor $\alpha$ to generate a first operating value $\alpha S_n$, wherein the first weighted factor $\alpha$ is a value less than 1. Next, the second multiplier 272 multiplies the initial overdriving voltage setting $S_e$ of a specific pixel located at the edge part in the current frame with a second weighted factor $\beta$ to generate a second operating value $\beta S_e$. Finally, the adder 273 sums up the first operating value $\alpha S_n$ with the second operating value $\beta S_e$ to generate the modified overdriving voltage setting $S_M$ of the specific pixel.

The driving voltage setting $S_n$ and the modified overdriving voltage setting $S_M$ are inputted into a multiplexer 280. The multiplexer 280 is an output device for outputting the driving voltage setting $S_n$ and the modified overdriving voltage setting $S_M$. As mentioned above, the non-edge part of the current frame can directly use the driving voltage setting $S_n$ to set a voltage supply circuit (not illustrated in the diagram) to provide the voltage dropped on two terminals of the liquid crystal layer, but the edge part has to use the modified overdriving voltage setting $S_M$ to set a voltage supply circuit to provide the voltage dropped on two terminals of the liquid crystal layer. Consequently, the multiplexer 280 selectively switches the driving voltage setting $S_n$ or the modified overdriving voltage setting $S_M$ to be the setting value of the voltage supply circuit according to whether the pixel belongs to the edge part or the non-edge part of the frame.

Figure 4:
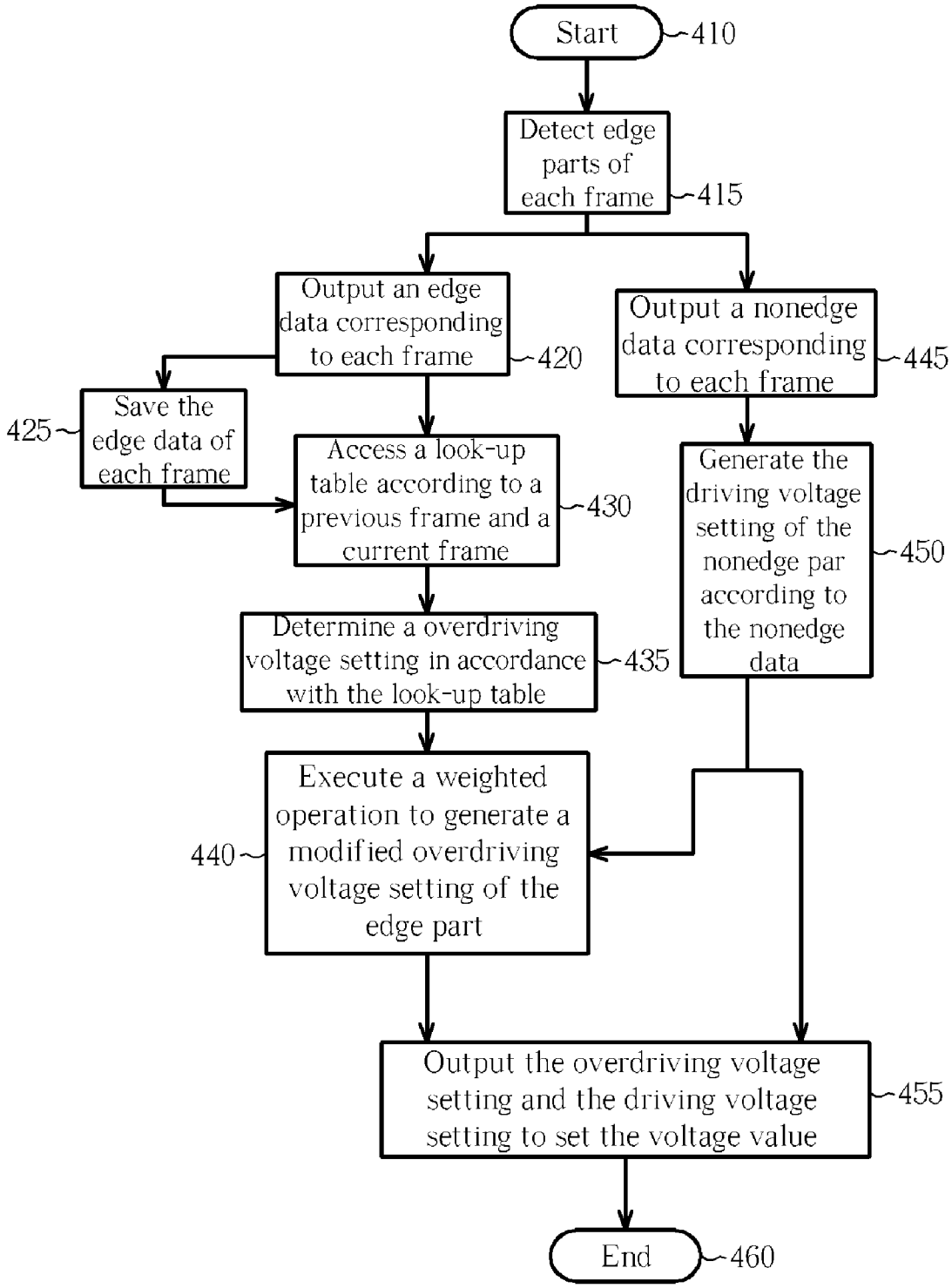
FIG. 4 is a flowchart of an LCD control method according to a preferred embodiment of the present invention.

Please refer to FIG. 4. FIG. 4 is a flowchart of an LCD control method according to a preferred embodiment of the present invention. Steps of the control method are described below:

Step 410: Start;

Step 415: Detect edge parts of each frame, then go to step 420 and step 445 sequentially;

Step 420: Output an edge data corresponding to each frame, then go to step 425 and step 430 sequentially;

Step 425: Save the edge data of each frame;

Step 430: Access a look-up table according to a previous frame and a current frame;

Step 435: Determine an overdriving voltage setting corresponding to the edge part of the current frame in accordance with the look-up table;

Step 440: Execute a weighted operation to generate a modified overdriving voltage setting according to the driving voltage setting of the non-edge part and the overdriving voltage setting of the edge part, then go to step 455;

Step 445: Output a non-edge data corresponding to each frame;

Step 450: Generate the driving voltage setting of the non-edge part in the current frame according to the non-edge data, then go to step 440 and step 455 sequentially;

Step 455: Output the overdriving voltage setting and the driving voltage setting to set the voltage value;

Step 460: End.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display control circuit, comprising:

an edge-detecting circuit for detecting image edges in a current frame of an image data, to divide data of the current frame into an edge data and a non-edge data;

a memory coupled to the edge-detecting circuit, for saving an edge data of a previous frame of the image data without saving a non-edge data of the previous frame;

a driving-decision circuit coupled to the edge-detecting circuit and the memory, for generating a driving voltage setting according to the non-edge data of the current frame outputted by the edge-detecting circuit, and generating an overdriving voltage setting according to the edge data of the previous frame and the edge data of the current frame outputted by the edge detecting circuit, and the driving-decision circuit comprises:

a non-edge-driving decision circuit for receiving the non-edge data of the current frame and generating the driving voltage setting corresponding to non-edge parts of the current frame;

an edge-driving decision circuit for receiving the edge data of both the current frame and the previous frame to generate the overdriving voltage setting corresponding to edge parts of the current frame; and a weighted circuit coupled to the non-edge-driving decision circuit and the edge-driving decision circuit, for executing a weighted operation according to the driving voltage setting and the overdriving voltage setting to adjust the overdriving voltage setting corresponding to the edge parts of the current frame; and an output device coupled to the driving decision circuit, for outputting the driving voltage setting and the overdriving voltage setting;

wherein the output device is a multiplexer.

2. The control circuit of claim 1, wherein the edge-detecting circuit detects the image edges in the current frame by referencing differences among gray level values of several pixels in the current frame.

3. The control circuit of claim 1, wherein the driving decision circuit comprises a look-up table, and the driving decision circuit generates the overdriving voltage setting according to the edge data of the previous frame, the edge data of the current frame, and the look-up table.

4. The control circuit of claim 3, wherein the driving decision circuit further comprises:

a storage unit for saving the look-up table.

5. The control circuit of claim 1, wherein the weighted circuit applies a first weighed factor to the driving voltage setting of at least one pixel in the non-edge part neighboring the edge part of the current frame to generate a first operating value; the weighted circuit also applies a second weighed factor to the overdriving voltage setting of a specific pixel in the edge part of the current frame to generate a second operating value; and then sums up the first and second operating values to adjust the overdriving voltage setting of the specific pixel.

6. The control circuit of claim 1, wherein the memory saves the edge data of the current frame temporarily.

7. A liquid crystal display control method, comprising:

detecting image edges in a current frame of an image data, to divide data of the current frame into an edge data and a non-edge data;

saving an edge data of a previous frame of the image data without saving a non-edge data of the previous frame;

generating a driving voltage setting according to the non-edge data of the current frame and generating an overdriving voltage setting according to the edge data of the previous frame and the edge data of the current frame, and the step of generating the overdriving voltage setting comprises:

receiving the non-edge data of the current frame and generating the driving voltage setting corresponding to non-edge parts of the current frame;

receiving the edge data of both the current frame and the previous frame to generate the overdriving voltage setting corresponding to edge parts of the current frame; and executing a weighted operation according to the driving voltage setting and the overdriving voltage setting to adjust the overdriving voltage setting corresponding to the edge parts of the current frame; and outputting the driving voltage setting and the overdriving voltage setting by using a multiplexer.

8. The control method of claim 7, further comprising:

deciding the image edges in the current frame by referencing differences among gray level values of several pixels in the current frame.

9. The control method of claim 7, wherein the overdriving voltage setting is determined through accessing a look-up table.

10. The control method of claim 7, wherein the weighted operation generates a first operating value by means of applying a first weighed factor to the driving voltage setting of at least one pixel in the non-edge part neighboring the edge part of the current frame; the weighted operation also generates a second operating value by means of applying a second weighed factor to the overdriving voltage setting of a specific pixel in the edge part of the current frame; and the weighted operation then sums up the first and second operating values to adjust the overdriving voltage setting of the specific pixel.

11. The control method of claim 7, wherein the edge data of the current frame is saved in a memory.

* * * * *